United States Patent [19]

Grogan

[11] Patent Number: 4,466,341

[45] Date of Patent: Aug. 21, 1984

[54] FUME HOOD ENERGY CONTROLLER

[76] Inventor: Dennis R. Grogan, P.O. Box 162, Andover, Mass. 01810

[21] Appl. No.: 450,754

[22] Filed: Dec. 17, 1982

[51] Int. Cl.[3] ..... F23J 11/00

[52] U.S. Cl. ..... 98/115 LH; 340/611

[58] Field of Search ..... 98/43 R, 43 A, 43 B, 98/115 R, 115 LH; 340/611

[56] References Cited

U.S. PATENT DOCUMENTS

| | | | |
|---|---|---|---|
| 3,874,754 | 4/1975 | Saunders et al. | 98/41 R |
| 4,121,199 | 10/1978 | Young | 340/611 |
| 4,160,407 | 7/1979 | Duyn | 98/115 R |

FOREIGN PATENT DOCUMENTS

| | | | |
|---|---|---|---|
| 2657067 | 6/1978 | Fed. Rep. of Germany | 98/115 R |
| 1591888 | 7/1981 | United Kingdom | 98/115 LH |
| 283540 | 6/1971 | U.S.S.R. | 98/115 LH |

OTHER PUBLICATIONS

D. Rude, "Exhaust Alarm", *IBM Technical Disclosure Bulletin*, IBM Corporation, vol. 25, No. 6, Nov. 1982.

*Primary Examiner*—Albert J. Makay
*Assistant Examiner*—Harold Joyce
*Attorney, Agent, or Firm*—Thompson, Birch, Gauthier & Samuels

[57] ABSTRACT

A control system for a fume hood, wherein limit switches sense the position of the sash, and pressure and light sensors monitor pressure changes in the fume hood and ambient light. A low volume fan continously draws air through the fume hood. When the sash is opened the high volume fan is actuated. Air flow is monitored as the sash position is changed; and an alarm system is actuated when an unsafe condition exists.

7 Claims, 3 Drawing Figures

FUME HOOD ENERGY CONTROLLER

BACKGROUND AND BRIEF SUMMARY OF THE INVENTION

It is well established in energy circles, that laboratory buildings are among the most energy intensive. A sufficient contributor to this reputation is the energy used in the operation of fume hoods, a ubiquitous and seemingly indispensable piece of scientific apartatus. Fume hoods insure that chemical and biological experiments using volatile or otherwise dangerous chemicals are contained in a well ventilated space designed specifically to protect the researcher.

Past efforts to secure fume hoods not in use has led to near disasters. Some positive flow of air is always required to insure the safety of the laboratory.

A system has now been discovered that insures safe positive ventilation while reducing air flow during off hours and the energy savings are considerable.

Broadly speaking, limit switches sense the sash position and vary the air flow between a high volume flow when the sash is in an open position, and a low volume flow when the sash is in a closed position. Sensors also determine if the velocity through the hood is proper and, if not, actuate an alarm. A light sensor measures the ambient light in the room. If the light is too low and the high volume fan is on an alarm is actuated generally indicating the sash is open after hours. The low volume fan operates continously. The system, in total, ensures that when not in use the sash will be closed allowing the minimal air flow; and if there is a safty problem i.e., no negative air flow an alarm is actuated.

DESCRIPTION OF THE PREFERRED EMBODIMENT

Figure 1:
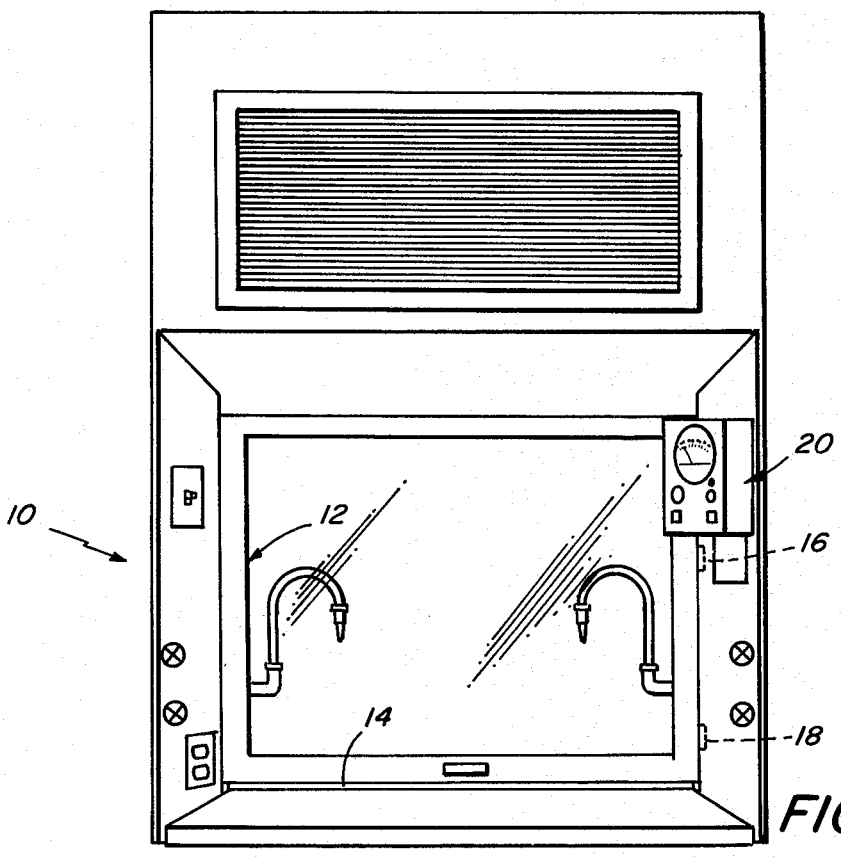
FIG. 1 is a front schematic of a fume hood embodying the invention.

In FIG. 1 a fume hood is shown at 10 and includes a sash 12, defining in its closed position with the floor of the hood an opening 14. Reed switches 16 and 18 are secured to the frame of the hood and are adapted to be actuated by a magnet (not shown) secured to the sash 12. The switches 16 and 18 electrically communicate with a controller 20 physically secured to the hood 10. The switch 18 also communicates with a pneumatic actuator, which actuator controls a damper in the fume hood duct. The controller 20 is also joined to the hood and leads from the controller are joined to a high volume fan as will be described.

Figure 2:
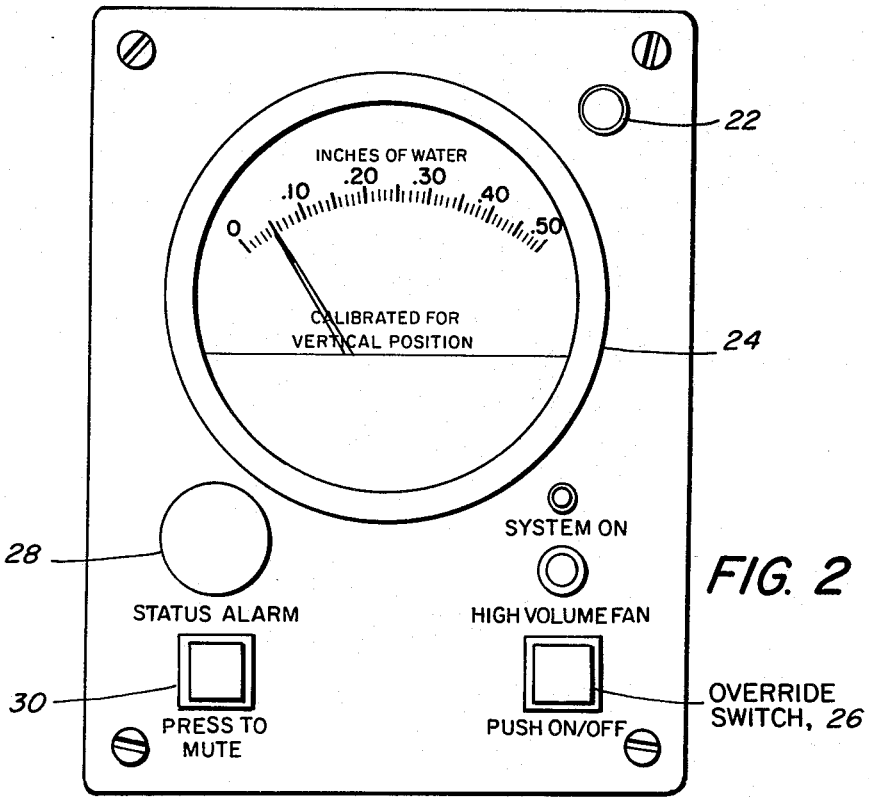
FIG. 2 is a front schematic of a controller.

The controller is shown in FIG. 2 and includes an ambient light detector 22 and a pressure gage 24. Status alarms (audio/visual) 28 and a mute button 30 manifest and control the alarm signals; and a high volume fan override switch 26 is provided.

The operation of the invention will be described in reference to FIG. 3.

Figure 3:
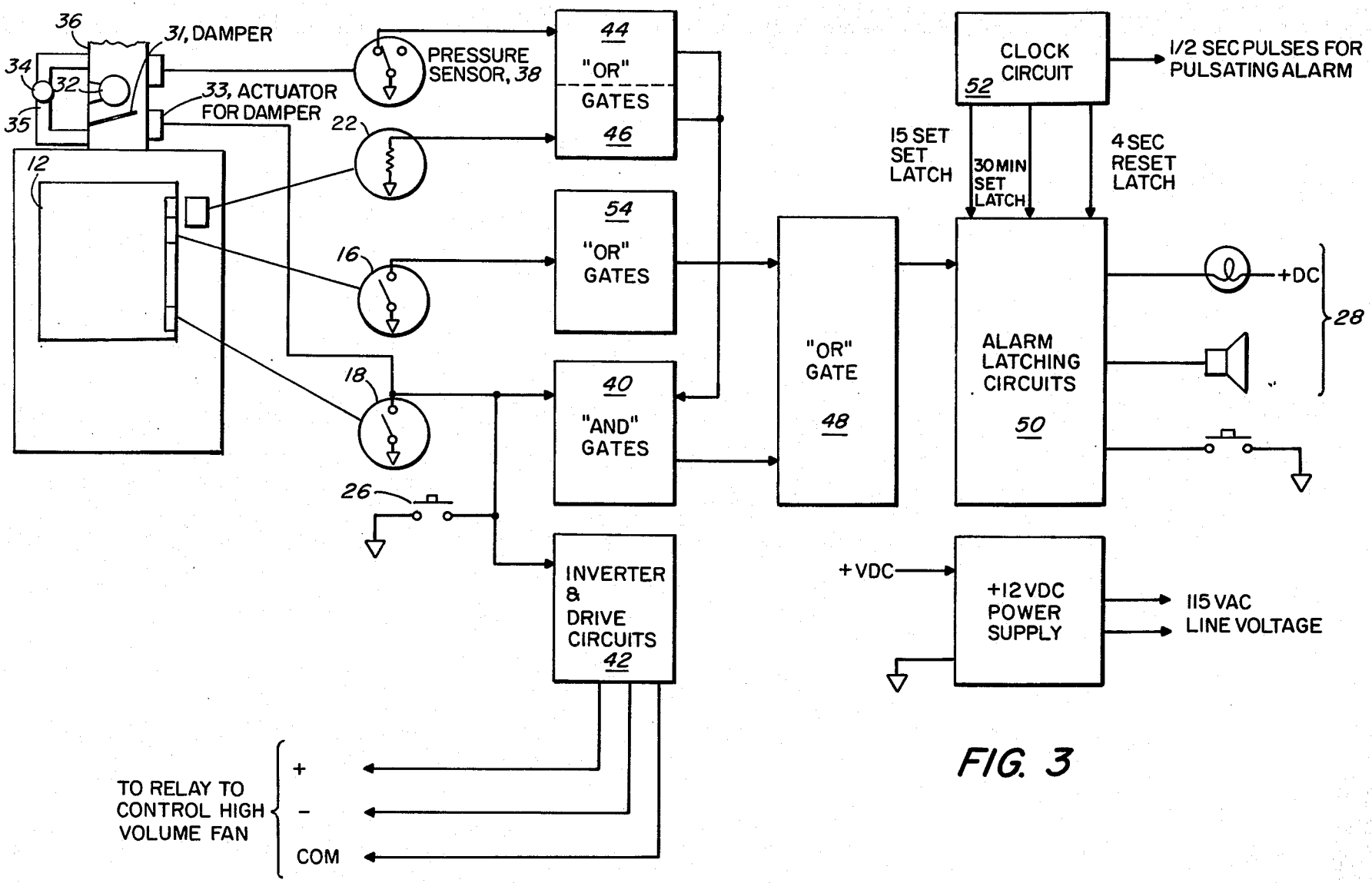
FIG. 3 is a functional block diagram and schematic of the logic of the controller.

Referring to FIG. 3 the fume hood 10 is shown schematically and the sash 12 is shown in its open position. Disposed within a duct 36 is a high volume fan 32. A damper 31 is placed in the hood. The damper 31 is controlled by an actuator 33 which moves the damper between an open and a closed position. The actuator communicates directly with the switch 18. The high volume fan is part of the standard fume hood assembly. As shown, the output from the inverter and drive circuits 42 is wired directly to the high volume fan. A bypass duct 35 is secured to the duct 36. A low volume fan 34 is physically secured in the bypass duct 35 and wired for continuous operation independent of the controller 20. When the sash is in its closed position the opening 14 is defined and the low volume fan 34 (as described above) is continuously running ensuring air flow through the hood. Also the damper 31 is in its closed position. This results in the air flowing through the by pass duct 35.

When the sash is moved to an open position the lower sash switch 18 is actuated providing an output to the AND gate 40. An output is also provided to the inverter and drive circuits 42 to actuate the high volume fan 32. An output is also provide to the activator 33 to move the damper 31 to its open position.

A pressure sensor 38 which forms a portion of the static pressure gage 24 communicates with an OR gate 44. The photocell or ambient light detector 22 communicates with an OR gate 46. When a signal is received from either the pressure sensor 38 or the photocell 22 or both, it is transmitted to the AND gate 40. An output is provided to the OR gate 48 which transmits its output to the alarm latching circuits 50. The alarm latching circuits 50 actuate the audio-visual status alarm 28 which has both a visual light signal and a beeping audio signal. The beeping signal may be overridden by the mute bottom 30 but as long as an alarm condition exists every 15 minutes the clock circuit 52 will latch the alarm circuits 50 to actuate the audio alarm.

The purpose of the photocell 22 is to insure that when the fume hood 10 is not in use that steps will be taken to move the sash to its closed position. When the sash is in its closed position the high volume fan is not operating and the low volume fan maintains the air flow through the fan hood. The high volume fan may be in the order of one horsepower while the low fan may be in the order of 1/40th of a horsepower. When work has ceased in the laboratory and the lights are shut off the photocell 22 will sense the reduction in ambient light. When the ambient light falls below a pre-established level an alarm signal is generated when the ambient light is below that pre-established level and the high volume fan is operating.

The pressure sensor 38 has a range from 0 to 0.5 inches of water and will provide a signal when less than normal negative static pressure is sensed.

If the sash is opened beyond the upper sash switch 16 then an output is provided to the OR gate 54. The total safe opening of the sash is typically determined by OSHA regulations. When the upper sash switch 16 is actuated the high volume fan continues to run but the alarm latching circuits 50 are actuated via OR gate 48. As previously described both the audio and visual alarms function in this mode.

In this preferred embodiment the clock circuit is adapted to actuate the audio-visual alarm 28 every 30 minutes with an automatic reset every four seconds. This is to provide a constant reminder that the sash should not be in the open position unless the fume hood is being used.

When the sash 12 is closed actuating the limit switch 18 the high volume fan 32 is shut off and the actuator 33 moves the damper 31 to its closed position. Through the entire sequence of operations the low volume fan 36 continues to run.

Other modifications to my invention will appear to those skilled in the art such as providing a common station to monitor a plurality of fume hoods from a single location. As described with my invention, the fractional horsepower low volume fan is sufficient to provide the necessary air flow through the fume hood when it is not in actual use. Although described is reference to fume hoods generally my inventive concepts are equally applicable to fume hoods.

Having described my invention what I now claim is:

1. In a system for controlling the operation of a fume hood wherein the fume hood includes a first high volume fan disposed in a first duct to draw air through the hood and a sash slideably mounted in the hood the improvement which comprises;

(a) a second duct to bypass the high volume fan;

(b) a second continuously operating low volume fan secured within the bypass duct;

(c) a damper disposed in the first duct upstream of the first fan;

(d) means to sense the pressure within the first duct and to provide an alarm output if the pressure violates a pre-established level which violation corresponds to an alarm condition;

(e) means to sense the position of the sash in a first closed position;

(f) means to sense the position of the sash in a second open position;

(g) means to actuate the damper between an open position when the sash is in its open position, and to actuate the damper to a closed position when the sash is its closed position;

(h) status alarms; and (i) means in communication with the first fan, the means to sense the pressure and the means to sense the position of the sash and the status alarms to i. actuate the status alarms when a pressure alarm is sensed and the first fan is operating;

ii. to actuate the first fan to a non-operating mode when the position of the sash in the first position is sensed; and iii. to actuate the first fan to an operating mode when the sash moves from its closed to its open position; and iv. to actuate the status alarm when the position of the sash exceeds the second position.

2. The system of claim 1 wherein the alarm system comprises a video alarm and an audio alarm and include means to override the audio alarm; and further comprises timing means to actuate the alarm periodically while said alarm condition exists.

3. The system of claim 2 wherein the timing means comprises means to actuate periodically the status alarm when alarm condition exists, and to maintain the actuated alarm for a predetermined period of time.

4. The system of claim 1 wherein the pressure sensed is negative static pressure.

5. The system of claim 1 wherein the ratio of horsepower of the first fan to the second fan is greater than ten to one.

6. The system of claim 1 which includes means to actuate the first fan independently of the positions of the sash.

7. The system of claim 1 which includes means to sense the ambient light and provide an alarm output if the light intensity violates a pre-established level, which violation corresponds to an alarm condition.

* * * * *